US005226968A

United States Patent [19]

Ohmi et al.

[11] Patent Number: 5,226,968

[45] Date of Patent: Jul. 13, 1993

[54] APPARATUS AND METHOD FOR OXIDATION TREATMENT OF METAL

[75] Inventors: Tadahiro Ohmi, 1-17-301, Komegabukuro 2-chome, Aoba-ku, Sendai-shi, Miyagi-ken 980, Japan; Kazuhiko Sugiyama, Sendai; Fumio Nakahara, Tokyo; Satoshi Mizokami, Sendai, all of Japan

[73] Assignee: Tadahiro Ohmi, Miyagi, Japan

[21] Appl. No.: 602,231

[22] Filed: Nov. 5, 1990

[30] Foreign Application Priority Data

Aug. 4, 1988 [JP] Japan ..... 63-195185

[51] Int. Cl.[5] ..... C23C 16/00

[52] U.S. Cl. ..... 118/720; 118/724; 118/725; 118/728; 118/715; 427/237; 427/239; 266/252; 266/254; 266/255; 266/258

[58] Field of Search ..... 427/237, 239; 118/715, 118/719, 720, 728, 725, 724; 266/252, 254, 255, 258

[56] References Cited

U.S. PATENT DOCUMENTS

| | | | |
|---|---|---|---|
| 3,164,493 | 1/1965 | Lindberg . | |
| 4,293,594 | 10/1981 | Yoldas | 427/437 |
| 4,636,266 | 1/1987 | Asay | 148/6.35 |

FOREIGN PATENT DOCUMENTS

| | | |
|---|---|---|
| 146115 | 6/1985 | European Pat. Off. . |
| 2536446 | 2/1977 | Fed. Rep. of Germany . |
| 614444 | 1/1987 | Fed. Rep. of Germany . |
| 097818 | 7/1955 | France . |
| 396405 | 3/1965 | France . |
| 066517 | 8/1971 | France . |
| 500613 | 8/1982 | France . |
| 2574221 | 6/1986 | France . |
| 61-79757 | 4/1986 | Japan . |
| 61-194168 | 8/1986 | Japan . |
| 61-281864 | 12/1986 | Japan . |

*Primary Examiner*—Richard Bueker
*Attorney, Agent, or Firm*—Baker & Daniels

[57] ABSTRACT

A metal oxidation treatment apparatus to form the passivation film on the surface of the metal to be oxidized such as stainless steel or the like, comprising an oxidation furnace, a gas inlet to introduce gas into said oxidation furnace, a discharge outlet to discharge the gas from said oxidation furnace, and a heater to heat said oxidation furnace to the predetermined temperature, so that the metal to be oxidized is heated and oxidized in dry oxidation atmosphere while gas is passed in said oxidation furnace.

6 Claims, 9 Drawing Sheets

APPARATUS AND METHOD FOR OXIDATION TREATMENT OF METAL

TECHNICAL FIELD

The present invention relates to the apparatus and the method for the oxidation treatment of metal, and particularly to the oxidation treatment apparatus and the method for the passivation of metal parts, which are to be used for ultra-high clean gas piping system or ultra-high vacuum equipment.

BACKGROUND OF THE INVENTION

In recent years, the technique to attain ultra-high vacuum or the technique to produce ultra-high clean reduced pressure atmosphere by introducing the gas at low flow rate into vacuum chamber is becoming increasingly important. These techniques are applied for the research of material characteristics, for the formation of various types of thin film, for the manufacture of semiconductor devices, etc. As the result, higher degree of vacuum is attained, while there is a strong demand on the reduced atmosphere, where the intermingling of impure elements and impure molecules could be reduced to utmost extent.

For example, in the manufacture of semiconductor devices, the dimensions of unit elements are being reduced year by year to attain higher integration of integrated circuit. Fervent research and development activities are carried out for the practical application of semiconductor devices having the dimension of 1 $\mu$m to submicron, or 0.5 $\mu$m or less.

Such semiconductor devices are manufactured by repeating the process to form thin film and the etching process of the film thus formed into the specified circuit pattern. Usually, such processes are performed in ultra-high vacuum conditions or in reduced pressure atmosphere with the specified gas by placing the silicon wafers into vacuum chamber. If the impurities are intermingled during these processes, the quality of thin film may be reduced or the precision fabrication may not be achieved. This is the reason why ultra-high vacuum and ultra-high clean reduced pressure atmosphere is wanted.

One of major reasons to hinder the actualization of ultra-high vacuum and ultra-high clean reduced pressure atmosphere has been the gas released from the surface of stainless steel widely used for the chamber of gas pipe. Above all, the source of the worst contamination has been the moisture adsorbed on the surface, which comes apart under vacuum or reduced pressure atmosphere.

FIG. 9 is a graphic representation showing the relation between total leakage of the system, including the gas piping system and reaction chamber in each apparatus (the sum of gas quantity released from inner surface of piping system and reaction chamber with the external leakage), and gas contamination. It is assumed that original gas does not contain the impurities. The lines in the diagram indicate the results when the values are changed with gas flow rate as parameter. Naturally, the lower the gas flow rate is, the more the concentration of the impurities increases as the influence of the released gas from inner surface becomes conspicuous.

In the semiconductor manufacturing process, there is a trend to increasingly reduce the gas flow rate in order to attain the process of higher accuracy by opening and filling the holes with high aspect ratio. For example, it is now normal to use the flow rate of several tens of cc/min. or less for the process to manufacture ULSI of submicron order. Suppose that the flow rate is 10 cc/min. and that the total leakage of the system is $10^{-3}$ to $10^{-6}$ Torr l/sec. as the apparatus currently in use, the purity of the gas is 1% to 10 ppm, and this is far from the high clean process.

The present inventors have invented the ultra-high clean gas supply system and have succeeded in reducing the leakage from outside the system to less than $1\times10^{-11}$ Torr l/sec. which is the detection limit of the detectors presently in use. However, the concentration of the impurities in the reduced pressure atmosphere could not be reduced due to the leakage from inside the system or due to the components of the released gas from the surface of said stainless steel. The minimum value of the surface released gas quantity as obtained by the surface treatment in the ultra-high vacuum technique at present is $1\times10^{-11}$ Torr l/sec. cm$^2$ in case of stainless steel. Suppose that the surface area exposed to the interior of the chamber is estimated to the minimum, e.g. to 1 m$^2$, the total leakage is $1\times10^{-7}$ Torr l/sec. This means that only the gas with purity of about 1 ppm can be obtained to the gas flow rate of 10 cc/min. The purity is doubtlessly decreased when gas flow rate is lowered further.

In order to decrease the released gas from inner surface of the chamber to $1\times10^{-11}$ Torr l/sec., i.e. to the same level as the external leakage of total system, it is necessary to set the released gas from the surface of stainless steel to less than $1\times10^{-15}$ Torr l/sec. cm$^2$. As the result, there is strong demand on the better processing technique for the surface of stainless steel to have lower gas release.

In the semiconductor manufacturing process, a wide variety of gas is used from the relatively stable common gas (such as $O_2$, $N_2$, Ar, $H_2$, He) to special gas having higher reactivity, corrosive property and toxicity. As the material for the piping and chamber for these gases, stainless steel is normally used because of its higher reactivity, corrosion resistance, high strength, easy secondary fabrication, weldability and easy polishing of inner surface.

Stainless steel shows excellent corrosion-resistant property in a dried gas atmosphere. Among the special gases, however, there are boron trichloride ($BCl_3$) or boron trifluoride ($BF_3$), which generates high corrosive property by generating hydrochloric acid or hydrofluoric acid through hydrolysis when moisture exists in the atmosphere. Thus, stainless steel is easily corroded when moisture exists in the gas atmosphere containing $BCl_3$ or $BF_3$. Therefore, anti-corrosion processing is indispensable after surface polishing of stainless steel.

As the anti-corrosion processing, there are the methods, one of which is Ni-W-P coating (clean escorting method) to coat the highly corrosion-resistant metal on stainless steel. There are some problems with this method because cracking and pinholes often occur and the adsorbed moisture on inner surface or the residual solution components increase because the wet type metalplating is employed. There is also another anti-corrosion processing method by passivation treatment to produce the oxide film on metal surface. Stainless steel is passivated when it is immersed in the solution containing sufficient quantity of oxidizer. In this method, stainless steel is usually immersed in the nitric acid solution at normal temperature or a little higher and the passivation treatment is performed. However, this method is also of wet type, and the residues of moisture and the processing solution remain on inner surface of the piping and the chamber. In the methods as described above, the existence of moisture adsorbed on inner surface gives severe damage to stainless steel when the gas of chlorine type or fluorine type is introduced.

Therefore, it is very important for the ultra-high vacuum technique or in the semiconductor manufacturing process to fabricate the chamber or the gas piping system with stainless steel having the passivated film, which is not easily damaged by corrosive gas and which occludes or adsorbs less moisture.

For example, in the passivation treatment of stainless steel pipe, the passivated film having excellent degassing property is obtained when heating and oxidation are performed in a highly clean atmosphere with moisture content of less than 10 ppb.

FIG. 10 summarizes the changes of moisture contained in the purge gas when the stainless steel pipes with different internal process conditions are purged at normal temperature. In the experiment, argon gas was passed at the flow rate of 1.2 l/min. through a stainless steel pipe of ⅜" with total length of 2 m, and the moisture content in argon gas at the outlet was determined by APIMS (atmospheric pressure ionization mass spectrometer).

The stainless steel pipes under test are divided into three types: (A) Stainless steel pipe with inner surface processed by electrolytic polishing; (B) Stainless steel pipe with inner surface processed by passivation treatment with nitric acid after electrolytic polishing; (C) Stainless steel pipe, on which the passivated film is formed by heating oxidation in highly clean and FIG. 10, these are represented by the curves A, B and C. The experiment was performed after leaving each of these stainless steel pipes in a clean room maintained at relative humidity of 50% and at temperature of 20° C. for about one week.

As it is evident from the curves A and B, a large quantity of moisture was detected from the electropolished pipe (A) and the electropolished pipe with passivation treatment with nitric acid (B). After gas was passed for about one hour, moisture of 68 ppb was detected in A and 36 ppb in B. Moisture content did not decrease after 2 hours, showing 41 ppb and 27 ppb in A and B respectively. In contrast, moisture content decreased to 7 ppb within 5 minutes after the gas was passed through the pipe (C) with the passivation film formed in high clean and dry atmosphere. After 15 minutes, it decreased to less than the background level of 3 ppb. Thus, it was demonstrated that (C) has excellent degassing property to adsorption gas.

However, in order to attain ultra-high clean oxidation atmosphere with moisture content of less than 10 ppb to produce the stainless steel pipe similar to (C) in FIG. 10, it is essential to have high-grade condition control. This involves higher cost and lower production efficiency and is not suitable for mass production. In other words, it is impossible to attain ultra-high clean oxidation atmosphere by the metal oxidation apparatus and metal oxidation method as conventionally employed.

Particularly, in the stainless steel pipes with smaller inner diameter such as ¼", ⅜", and ½", gas is very likely to stagnate, and oxidation treatment is performed with the inside of the stainless steel pipe exposed to atmospheric air, resulting in contamination. This makes it impossible to form the passivation film of good quality having superb corrosion-resistant property and with lesser moisture occlusion and adsorption. Because outer surface of stainless steel pipe is not directly related with the supply of ultra-high purity gas, the surface becomes contaminated after oxidation treatment due to roughness and dirtiness of the surface. The oxidation of outer surface of stainless steel pipe results in the problems such as poor external appearance or the generation of particles when pipes are installed in a clean room.

Therefore, there have been strong demands on the establishment of the mass production technique for the passivation treatment for stainless steel pipe in order that the passivation film is formed to provide inner surface with excellent corrosion-resistant property and to occlude or adsorb the moisture in lesser content and that outer surface is not oxidized.

The object of the present invention is to solve these problems by offering metal oxidation treatment apparatus and metal oxidation treatment method, by which the contamination caused by the released gas or the impurities such as moisture from the oxidized surface of stainless steel pipe is reduced and the stainless steel pipe for ultra-high vacuum and ultra-high clean reduced pressure apparatus and for gas supply system having excellent corrosion-resistant property can be produced in large quantity.

Another object of this invention is to offer metal oxidation treatment apparatus capable of self-cleaning and self-maintenance in addition to the above object.

DISCLOSURE OF THE INVENTION

The first point of this invention is to offer a metal oxidation treatment apparatus to form the passivation film on the surface of the oxidized metal such as stainless steel or the like, comprising an oxidation furnace, a gas inlet to introduce gas into said oxidation furnace, a discharge outlet to discharge the gas from said oxidation furnace, and a heater to heat said oxidation furnace to the predetermined temperature, wherein the oxidized metal is heated and oxidized in dry oxidation atmosphere while gas is flowing in said oxidation furnace.

The second point of this invention is to offer a metal oxidation treatment method to form the passivation film, in the oxidation furnace, on the surface of the oxidized metal such as stainless steel or the like, wherein the gas is passed into the oxidation furnace from the gas inlet to the outlet to discharge the gas from said oxidation furnace, said oxidation furnace is heated at the predetermined temperature by the heater, and the oxidized metal is heated and oxidized in dry oxidation atmosphere.

The third point of this invention is to offer a metal oxidation treatment apparatus of the first point, wherein a holder, concurrently used as a connection joint, is provided to fix the tubular oxidized metal such as stainless steel pipe in said oxidation furnace, said inlet is arranged to come into contact with one end of said tubular oxidized metal, said discharge outlet is arranged to come into contact with the other end of said tubular oxidized metal, and the heating oxidation is performed in dry oxidation atmosphere by passing the gas into said tubular oxidized metal.

The fourth point of this invention is to offer a metal oxidation treatment method of the second point, wherein a holder, concurrently used as a connection joint, is provided to fix the tubular oxidized metal such as stainless steel pipe in said oxidation furnace, the gas is introduced from one end of said tubular oxidized metal and is discharged from the other end of said tubular oxidized metal, and said tubular oxidized metal is heated and oxidized in dry oxidation atmosphere while gas is passed into said tubular oxidized metal.

The fifth point of this invention is to offer a metal oxidation treatment apparatus of the third point, comprising the other inlet to introduce the purge gas into said oxidation furnace arranged not to come into contact with said tubular oxidized metal and different from said inlet, and a discharge outlet different from said discharge outlet to discharge the gas from said oxidation furnace arranged not to come into contact with the other end of said tubular oxidized metal, wherein the preventive measures are taken to protect outer surface of said tubular oxidized metal from oxidation.

The sixth point of this invention is to offer a metal oxidation treatment method of the fourth point, wherein inert gas atmosphere is provided outside said tubular oxidized metal and the oxidation gas atmosphere is provided outside the metal, and preventive measures are furnished to protect outer surface of said tubular oxidized metal from oxidation.

The seventh point of this invention is to offer a metal oxidation treatment method of the fixth point, wherein the pressure of inert gas atmosphere outside said tubular oxidized metal is higher than the pressure of oxidation gas atmosphere inside said tubular oxidized metal.

The eighth point of this invention is to offer a metal oxidation treatment apparatus of either one of the first, the third or the fifth points, wherein, when said oxidized metal or said tubular oxidized metal is arranged or fixed in said oxidation furnace, said oxidation furnace is opened from said discharge outlet or said discharge outlet and the other outlet, a gas line for purge is connected to introduce the purge gas to said inlet or said inlet and the other inlet when opened, and said oxidized metal or said tubular oxidized metal is prevented from the exposure to atmospheric air when it is arranged or fixed in said oxidation furnace.

The ninth point of this invention is to offer a metal oxidation treatment method of either one of the second, the fourth, the sixth or the seventh point, wherein, when said oxidized metal or said tubular oxidized metal is arranged or fixed in said oxidation furnace, said oxidation furnace is opened from said discharge outlet or from said discharge outlet and the other outlet, the purge gas is passed through said oxidation furnace and/or said tubular oxidized metal, and that measures are taken to prevent the interior of said oxidized metal or of said tubular oxidized metal or outside or inside said tubular oxidized metal from the exposure to atmospheric air.

The tenth point of this invention is to offer a metal oxidation treatment apparatus of either one of the first, the third, the fifth or the eighth point, wherein a gas line is furnished to switch over the purge gas and the oxidation atmosphere gas to the inlet of said gas, a means is provided to permanently discharge the gas in the line not supplying gas to said oxidation furnace, of the purge gas line and the oxidation atmosphere gas line of said gas line, and the oxidation atmosphere is maintained at highly clean condition.

The eleventh point of this invention is to offer a metal oxidation treatment method of either one of the second, the fourth, the sixth, the seventh or the ninth point, wherein the gas is supplied in a gas line provided to switch over the supply of the purge gas and the oxidation atmosphere gas from said gas inlet to said oxidation furnace to the purge gas line and to the oxidation atmosphere gas line, and, of said purge gas line and said oxidation atmosphere gas line of said gas line, the gas in the line not supplying the gas to said oxidation furnace is permanently discharged to maintain the oxidation atmosphere in highly clean condition, and the purge gas line and the oxidation atmosphere gas line are switched over without decreasing the temperature of said oxidation furnace.

The twelfth point of this invention is t offer a metal oxidation treatment apparatus of either one of the first, the third, the fifth, the eighth or the tenth point, wherein a heater is provided on the oxidation atmosphere gas line and the purge gas line connected with said inlet or with said inlet and said other inlet, and the temperature of the gas to be supplied to said oxidation furnace is heated up to the temperature of the oxidation atmosphere.

The thirteenth point of this invention is to offer a metal oxidation treatment method of either one of the second, the fourth, the sixth, the seventh, the ninth and the eleventh point, wherein the gas supplied from said inlet or from said inlet and said other inlet is heated up to the temperature of the oxidation atmosphere by the heater, and the oxidation temperature is maintained at constant level to improve the oxidation efficiency.

In the present invention, stress is given to the efficient exclusion of the impurities such as moisture from the oxidation furnace when the oxidation furnace is closed, and the new gas is permanently introduced into the oxidation furnace and the gas is discharged from inside the oxidation furnace.

Specifically, the most important feature of this invention is to discharge the impurities such as moisture separated from the surface of the oxidized metal in the oxidation furnace to outside the oxidation furnace and to heat and oxidize the metal in dry oxidation atmosphere by introducing the gas into oxidation furnace and by discharging it permanently. This makes it possible to decrease the moisture content in the oxidation atmosphere to lower than the desired value (e.g. less than 10 ppb in case of stainless steel) and to form good passivation film on the surface of the oxidized metal.

In case oxidation treatment is performed in the interior of the oxidized metal pipe such as stainless steel pipe with smaller inner diameter, where gas is difficult to flow, the gas inlet and outlet are arranged in such manner that they come into contact with the ends of the pipe, and it is possible to pass the oxidation atmosphere gas into the pipe and to heat and oxidize the oxidized metal in dry and oxidation atmosphere. This makes it possible to decrease the moisture content in the oxidation atmosphere to lower than the desired value (e.g. less than 10 ppb) and to form good passivation film on the surface of the oxidized metal.

On the other hand, for preventing the oxidation of outer surface of the pipe, it is possible to perform oxidation by passing inert gas to outside the pipe in the oxidation furnace and to form the passivation film only on inner surface of the pipe without oxidizing the outer surface of the pipe. To obtain this effect more positively, it is desirable to increase the pressure of inert gas outside the pipe to higher than the pressure of the oxidation atmosphere gas inside the pipe and to prevent the leakage of oxidation atmosphere gas to outside the pipe by suppressing the gas flow from inside the pipe to outside the pipe.

Giving attention to the contamination before the oxidation furnace is closed, it was attempted in this invention to prevent the intermingling of the impurities such as moisture in the oxidation furnace when the oxidation furnace is opened. When the oxidation furnace is opened and the oxidized metal is arranged or fixed in the oxidation furnace, it is very effective, for preventing the exposure of the interior of oxidation furnace and the oxidized metal to the atmospheric air containing the impurities, to provide the opening on the side of discharge outlet of the oxidation furnace, to introduce the purge gas permanently from the inlet and to build up gas flow, which passes from inside the oxidation furnace to the opening. This makes it possible to prevent the atmospheric air from entering into the opened oxidation furnace and to reduce the time required for decreasing the moisture content in the oxidation atmosphere to lower than the desired value (e.g. less than 10 ppb).

It is also important to obtain the better effect to provide the supply system for the introduced gas with the function to permanently supply high purity gas. Particularly, in case two gas lines such as purge gas line and oxidation atmosphere gas line are connected with the inlet, contamination often occur within the system with impurities such as moisture when switched over from purge gas to oxidation atmosphere gas or from oxidation atmosphere gas to purge gas. This is mainly caused by the contamination with the released gas, mostly the moisture from inner wall of the pipe when the supply gas (e.g. $O_2$ as oxidation atmosphere gas) is stopped.

When the metal is to be heated and oxidized in the oxidation atmosphere, after the oxidized metal is arranged or fixed in the oxidation furnace, the baking and the purge are performed for the oxidation furnace and stainless steel pipe. Baking is performed at the same temperature as the oxidation temperature until the moisture content in the discharge gas becomes sufficiently low (e.g. less than 10 ppb). After the baking and the purge by the purge gas are completed, the gas to be supplied into the stainless steel pipe is switched over to the oxidation atmosphere gas (such as $O_2$) to start the oxidation treatment (passivation treatment). If the impurities, mostly moisture, are intermingled in the system during the switch-over of gas, heating and oxidation are performed in the atmosphere containing moisture. Therefore, it is necessary to decrease the temperature inside the oxidation furnace to room temperature for once, to purge the oxidation atmosphere gas when oxidation is not proceeding within the oxidation furnace and to perform the oxidation by increasing the temperature of oxidation furnace after the contaminants are completely removed However, the time as long as 12~24 hours is required for the treatment by decreasing temperature, and it is desirable to have the system, which is capable to reduce the contamination within the system as practical as possible when gas is switched over in order to shorten the oxidation time.

For this reason, a system is proposed, in which the inert gas supply line and the oxidation atmosphere gas supply line are switched over by mono-block valve, formed by integrating four valves to minimize dead space, and, of the inert gas supply line and the oxidation atmosphere gas supply line, the supply line not supplying gas to oxidation furnace is always discharged, preventing thereby the stagnation of gas and supplying ultra-high pure gas. This system makes it possible to maintain ultra-high purity of the supplied gas in stable and satisfactory conditions, to switch over the gas very easily and to eliminate the intermingling and the influence of the impurities during switch-over even when oxidation furnace is at high temperature. Specifically, this can be maintained if the moisture content of the atmosphere in the oxidation furnace is set to lower than the desired value (e.g. less than 10 ppb) for once, gas can be switched over without decreasing the temperature of oxidation furnace or performing long-time purge with gas in the oxidation furnace.

Further, by installing the heater in the gas supply system, it is possible to heat the introduced gas to the temperature equal to that of the oxidation atmosphere in oxidation furnace, to maintain the temperature of the oxidation atmosphere, to perform positive temperature control in the oxidation furnace and to improve the oxidation efficiency.

Thus, it is possible to create an even passivation film on the surface of the oxidized metal, to reduce the impurities caused by the released gas from the surface, and to provide a metal oxidation apparatus and a metal oxidation method to offer the parts for ultra-high vacuum and ultra-high clean reduced pressure apparatus and gas supply piping system having excellent anti-corrosion property against the reactants and corrosive gases.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

In the following, an embodiment of the present invention will be described in connection with the drawings.

Figure 1:
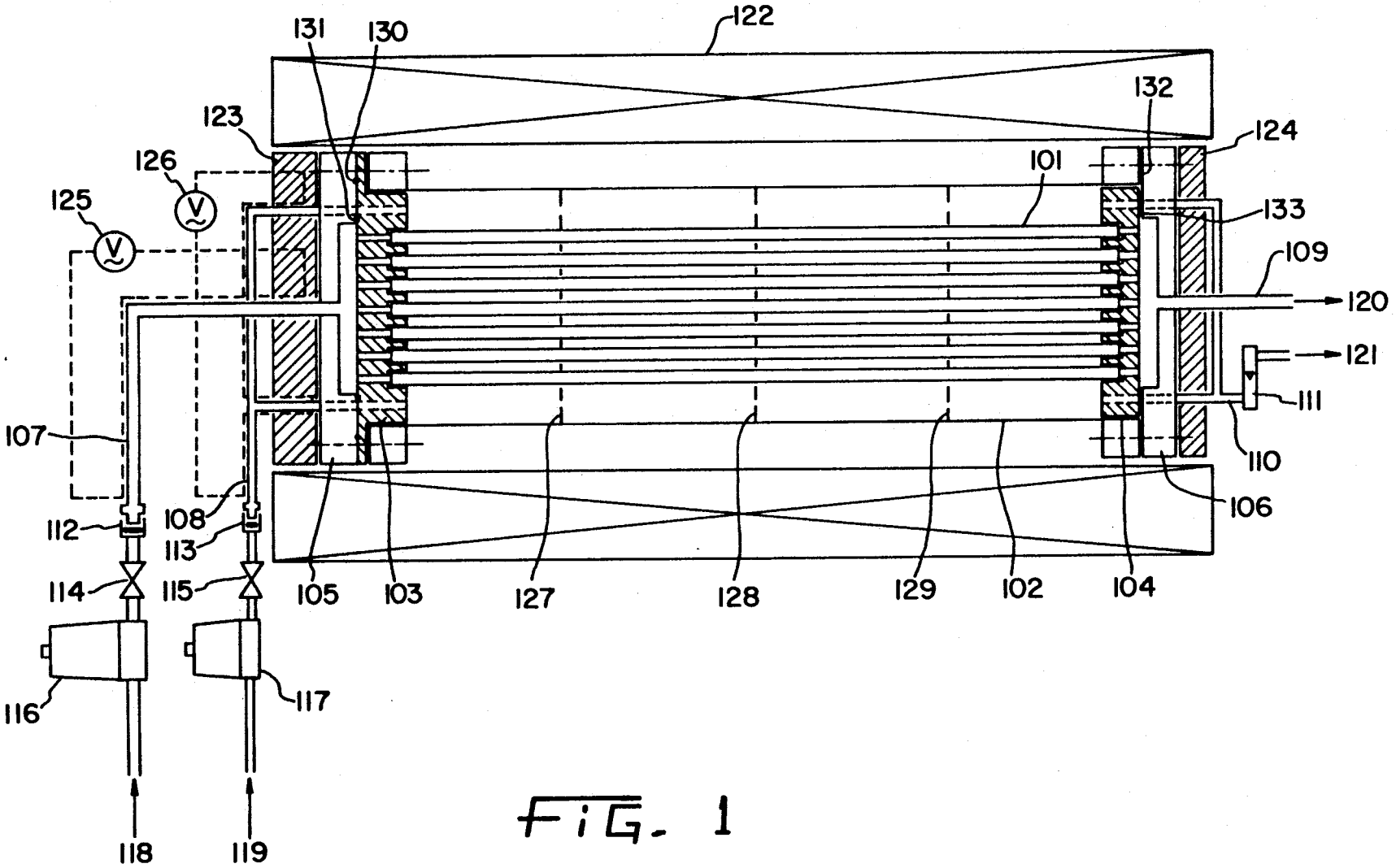
FIG. 1 is a cutaway view of an embodiment according to the present invention.

FIG. 1, 101 represents a stainless steel pipe, i.e. a metal pipe to be oxidized, which is usually a pipe or SUS316L of ¼", ⅜" and ½"0 in diameter with electropolished inner surface. Normally, 20~100 pieces of this pipe with regular size of 2 m or 4 m are used. Naturally, the pipe may have the diameter other than above. 102 shows an oxidation furnace. This may be made of quartz pipe, but it is desirable to fabricate it with stainless steel with inner surface processed by electropolishing and passivation treatment if conseration is given to thermal expansion and gas-tightness of stainless steel pipe 101 when heating oxidation is performed. 103 and 104 are the airtightness to stainless steel pipe 101 to pass the gas. To provide airtightness when it is inserted into stainless steel pipe and heated, it is desirable to fabricate them with the material having lower thermal expansion coefficient than stainless steel, with easier internal treatment and with less influence from the released gas. 105 and 106 indicate the flanges, which have such shape that gas flow becomes uniform in relation to each stainless steel pipe. 107 is a gas inlet pipe to supply the purge gas (such as Ar) and oxidation atmosphere gas (such as $O_2$) into the stainless steel pipe, and 108 is a gas inlet pipe to supply inert gas (such as Ar) to provide inert gas atmosphere outside the stainless steel pipe and to prevent the contamination of outer surface of stainless steel pipe by oxidation. 109 and 110 show the gas discharge lines to discharge the gas flowing inside and outside the stainless steel pipe respectively. The gas inlet pipes 107 and 108 and the discharge lines 109 and 110 are made of SUS316L pipes of ⅜", ½", etc. with electropolished inner surface. The opening from the gas inlet pipe 107 to oxidation furnace 102 is the inlet, and the opening from gas inlet pipe 108 to oxidation furnace 102 is another inlet. The opening from the discharge line 109 to the oxidation furnace 102 is the discharge outlet, and the opening from discharge line 110 to oxidation furnace 102 is another discharge outlet. 111 represents a float type flowmeter, and 116 and 117 are the mass flow controllers which regulates the flow rate of gas in the oxidation furnace 102 and calculates the gas quantity flowing from 116, 117 and 111 to stainless steel pipe 101. Mass flow controller may be used for 111, and float type flowmeter with needle valve may be used for 116 and 117, but it is desirable to use mass flow controllers for 116 and 117 in order to maintain the atmosphere in the oxidation furnace 102 highly clean. 112 and 113 are MCG (metal C-ring type) joints, which are used to separate the gas inlet pipes 107 and 108 from gas supply pipe when the flange 105 is detached. It is desirable to use MCG joint to provide the conditions free of external leakage and particles. 114 and 115 are the stop valves. 118 is a gas supply piping line to supply inert gas (such as Ar) and oxidation atmosphere gas (such as $O_2$) inside the stainless steel pipe 101, and 119 is a gas supply piping line to furnish inert atmosphere (such as Ar atmosphere) inside the oxidation furnace 102. 120 and 121 are the discharge lines. 122 is a heater to heat the oxidation furnace 102, and it is desirable to provide two-piece type electric furnace with wiring in longitudinal direction, considering the maneuverability and uniform oxidation temperature. 123 and 124 are the heat insulating materials to prevent the heat radiation toward longitudinal direction of electric furnace and to maintain the temperature in oxidation furnace 102 at uniform level as practical as possible 125 and 126 are the heaters to heat the gas introduced in the oxidation furnace 102 up to the oxidation temperature. 127, 128 and 129 are the plates, serving as the supports to stainless steel pipe 101, and it is desirable to use stainless steel from the viewpoints of out-gas-free and particle-free conditions or of thermal expansion. 130, 131, 132 and 133 are the packings to seal the oxidation furnace 102 and the flanges 105 and 106, and it is desirable to use the material having elasticity at more than 500° C. (such as nickel alloy) from the viewpoint of heating oxidation temperature.

Next, the functions and operating procedure of this apparatus will be described in connection with the drawings.

Figure 2:
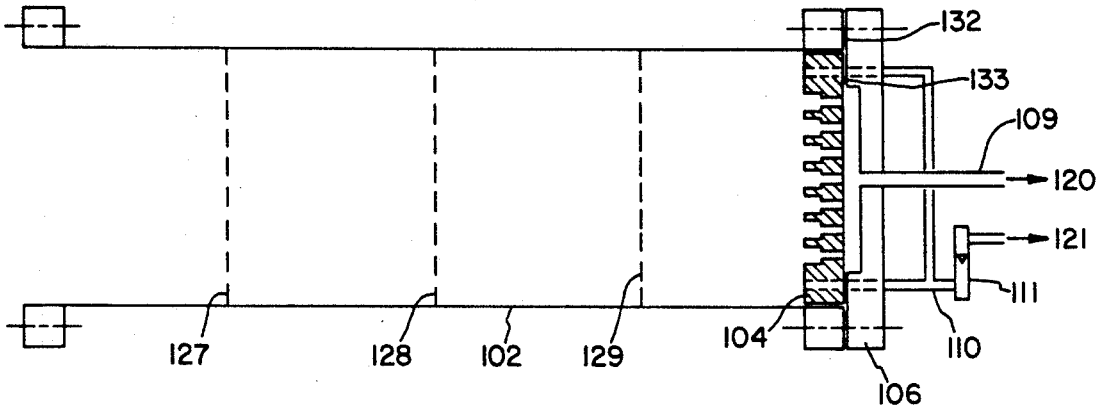
FIG. 2 is a cutaway of the present invention showing the condition where the oxidation furnace is opened wherein the stainless steel pipe is not yet accommodated.

FIG. 2 shows the condition where the oxidation furnace 102 is opened and stainless steel pipe is not yet accommodated. In the passivation treatment technique, it is necessary to open it in an atmosphere as clean as possible because the cleanness of the atmosphere gives strong influence on the thickness and quality of the passivation film. For this reason, the condition of FIG. 2 is maintained in as short time as possible to minimize the contamination inside the oxidation furnace 102 by atmosphere air.

If the contamination by atmospheric air is taken into account, it is most desirable to take the method, in which the flange to be opened is set on the side of 106, the purge gas (such as Ar) is continuously flown from 105 and the atmospheric air is prevented from intermingling in the oxidation furnace 102. In this case, however, it is necessary to install the connection joint to detach the flange 106 on the discharge lines 120 and 121, similar to the connection joints 112 and 113 as shown in FIG. 1.

Figure 3:
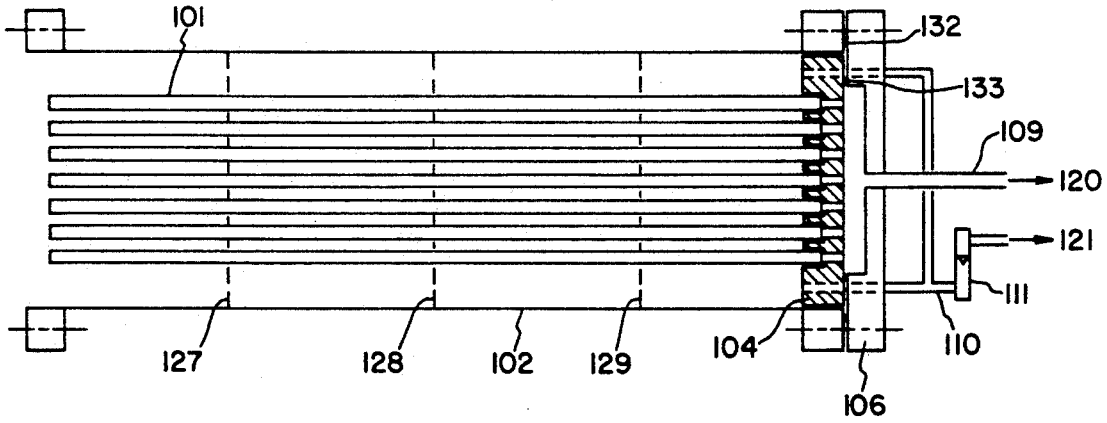
FIG. 3 is a cutaway view of the present invention showing the condition where the stainless steel pipe is accommodated to perform oxidation treatment inside the oxidation furnace after the condition of FIG. 2.

FIG. 3 shows the condition where stainless steel pipe 101 is accommodated to perform oxidation treatment inside the oxidation furnace after the condition of FIG. 2. Guided by the supports 127, 128 and 129, stainless steel pipe 101 is inserted into the holder 104 and fixed. Similarly to the case of FIG. 2, the intermingling of atmospheric components must be prevented as practical as possible. The operation must be carried out as quickly and as carefully as possible.

Figure 4:
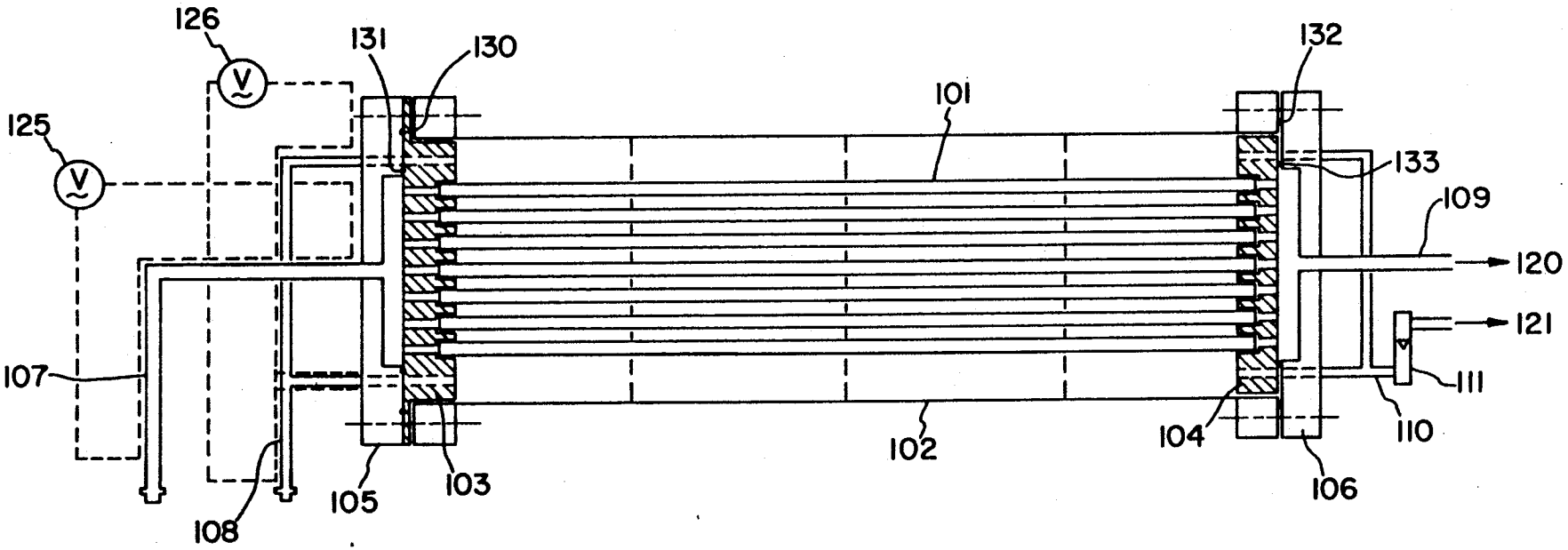
FIG. 4 is a cutaway view of an embodiment of the present invention showing the condition after that of FIG. 3 the holder and the flange are mounted on the oxidation furnace where the stainless steel pipe is set.

FIG. 4 gives the condition, where, after the condition of FIG. 3, the holder 103 and the flange 105 are mounted on the oxidation furnace 102, where stainless steel pipe 101 is set.

Figure 5:
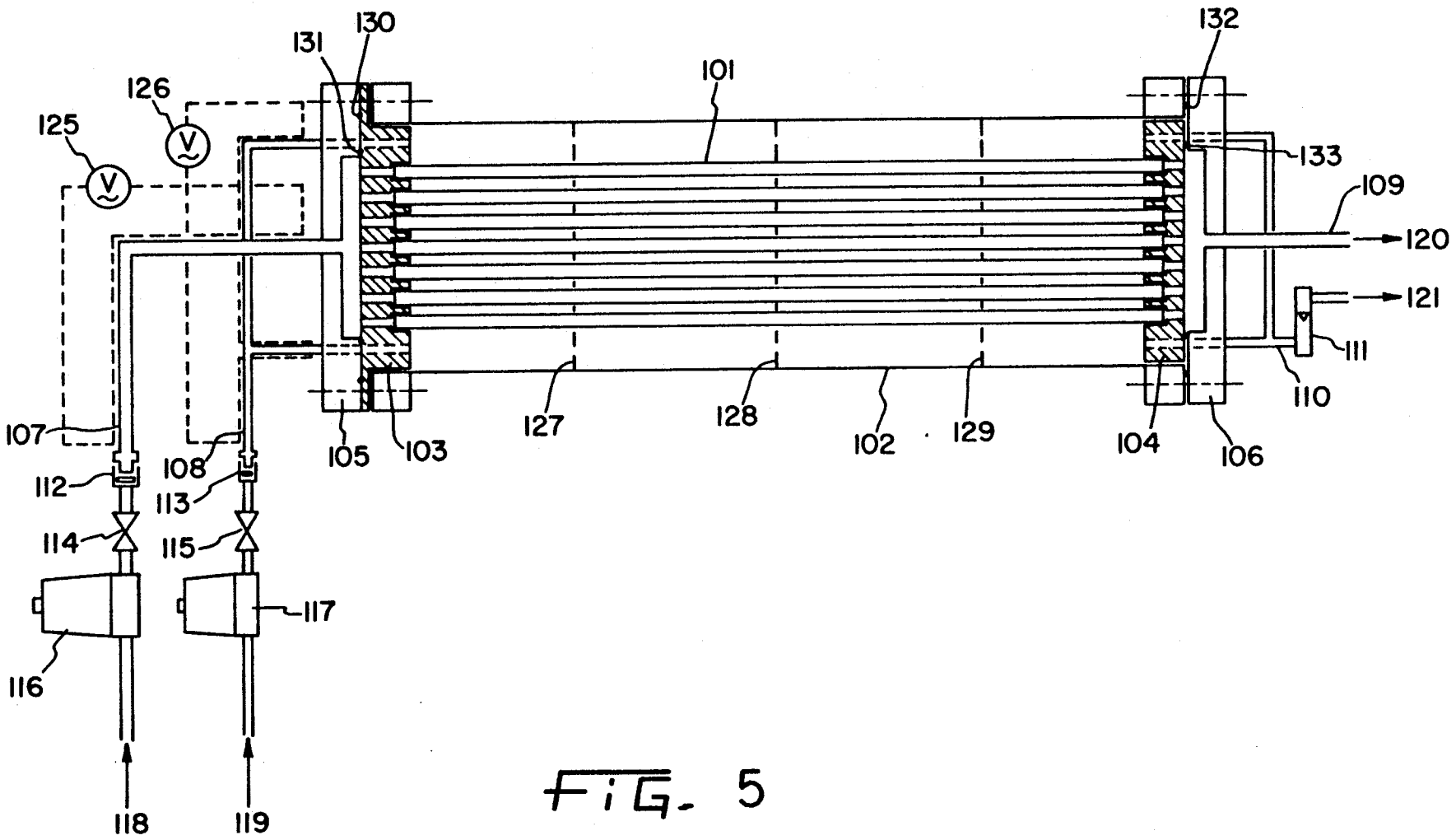
FIG. 5 is a cutaway view of the embodiment of the present invention after the condition of FIG. 4 wherein the gas supply pipes are connected with the gas inlet pipes.

FIG. 5 shows the condition, where, after the condition of FIG. 4, the gas supply pipes 118 and 119 are connected with the gas inlet pipes 107 and 108 respectively. Under this condition, the purge gas (such as Ar) is passed into the stainless steel pipe 101 and the oxidation furnace 102, and the atmosphere inside the oxidation furnace 102 contaminated by atmospheric air is replaced by inert gas atmosphere. The flow rate of the purge gas naturally differs according to the number of stainless steel pipes processable at one time and to the size of oxidation furnace 102. For example, purging is performed with a large quantity of gas for 2–4 hours at flow rate of 2 ~ 10 m/sec. to eliminate the contaminants, mostly moisture, inside the oxidation furnace 102.

Figure 6:
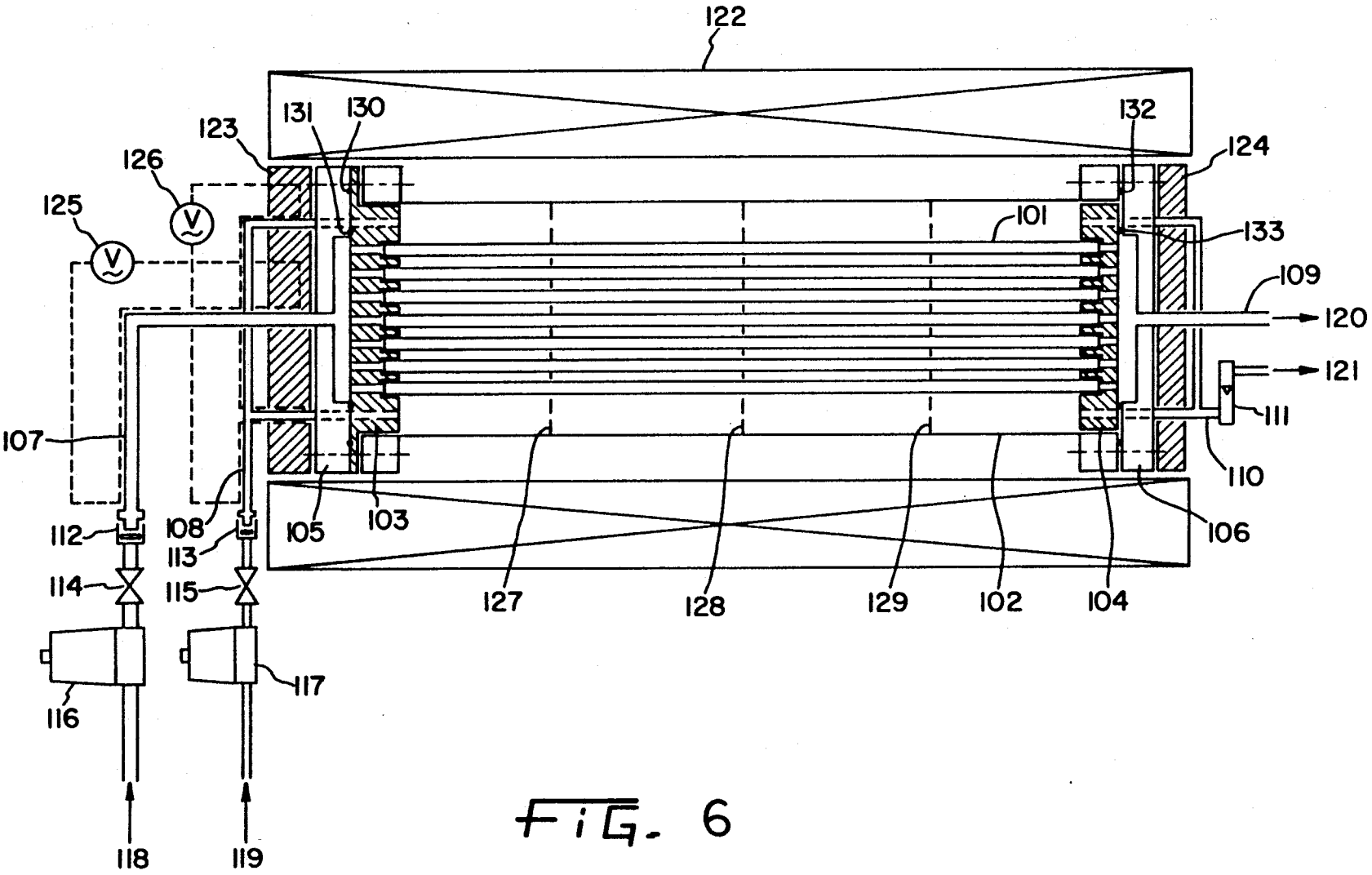
FIG. 6 is a cutaway view of an embodiment of the present invention showing the condition after the condition of FIG. 5 wherein the heater is set.

FIG. 6 shows the condition where, after the condition of FIG. 5, the heater 122 is set. Under this condition, baking and purge of the oxidation furnace 102 and the stainless steel pipe 101 are performed. Baking is performed at the same temperature as oxidation temperature (e.g. 400° ~ 550° C.) until the moisture content in the gas at the outlet is reduced to less than 5 ppb. In this case, the heaters 125 and 126 of the gas inlet pipe are also heated simultaneously, and the temperature of the gas introduced into oxidation furnace 102 is set to the oxidation temperature (e.g. 400° ~ 550° C.) in order to prevent the temperature decrease inside the oxidation furnace 102 due to the introduction of gas. After baking and purge by the purge gas are completed, the gas supplied into stainless steel pipe 101 is switched over to oxidation atmosphere gas (such as $O_2$), and oxidation (passivation treatment) is started.

During the switch-over of gas, the contaminants, mostly moisture, enters the system. For this reason, it is desirable to decrease the temperature in the oxidation furnace 102 to the room temperature for once, to switch over the gas from the purge gas to the oxidation atmosphere gas (such as $O_2$) and to perform oxidation by increasing the temperature of oxidation furnace 102 after purging the oxidation atmosphere gas and completely removing the contaminants while oxidation reaction is still not advanced in the oxidation furnace 102.

However, the time as long as 12 ~ 24 hours is required for decreasing the temperature. Therefore, it is necessary to reduce the oxidation time by providing the piping system to minimize the contamination of the system during gas switch-over and by switching over the gas while the oxidation furnace 102 is at high temperature.

The contamination of the system, mostly by moisture, during the gas switch-over from the purge gas to the oxidation atmosphere gas or from the oxidation atmosphere gas to the purge gas is caused by the contamination by the released gas, mostly moisture, from inner wall of the pipe because the supplied gas (such as $O_2$) is stagnated there. Consequently, it is desirable to set up a system where the oxidation atmosphere gas and the purge gas can be always purged and to reduce the contamination in the system during gas switch-over.

Figure 8:
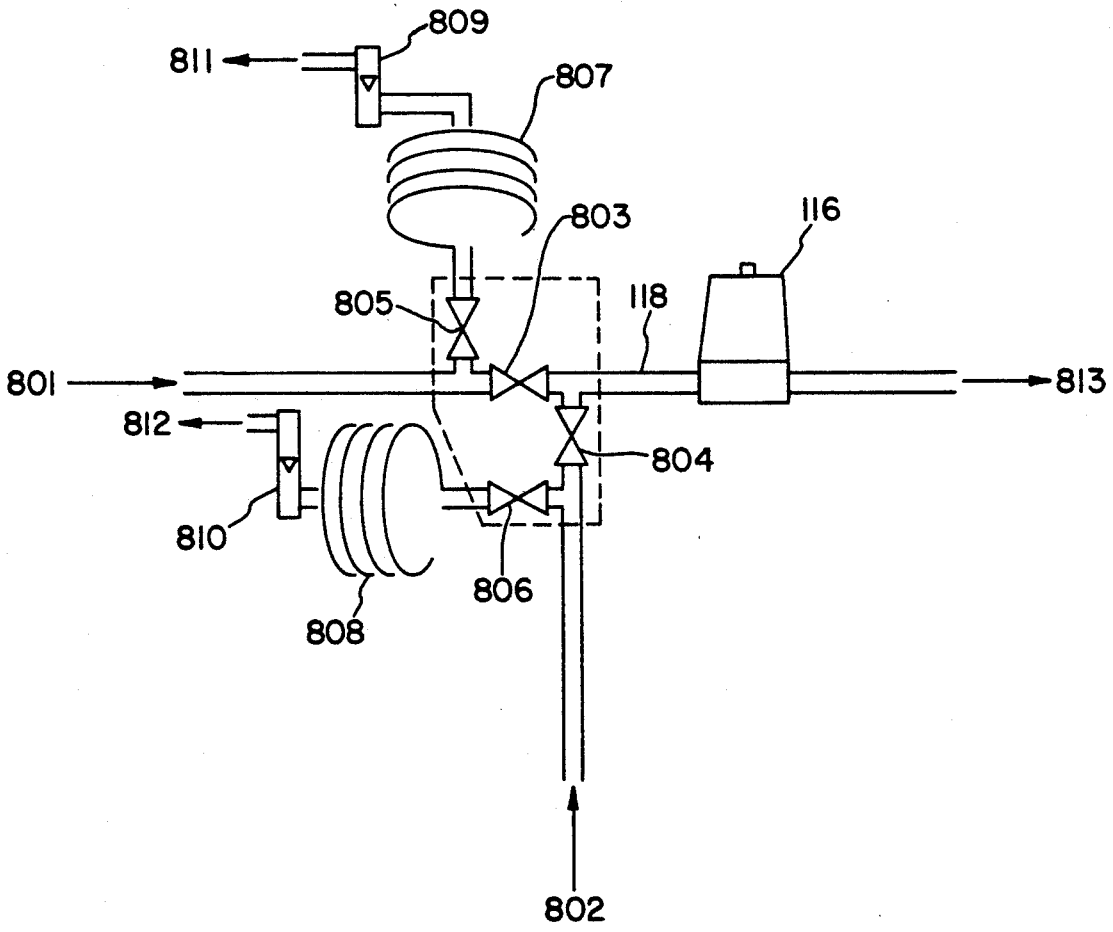
FIG. 8 is a schematic representation of an example of the piping system to prevent system contamination during gas switch over.
Figure 9:
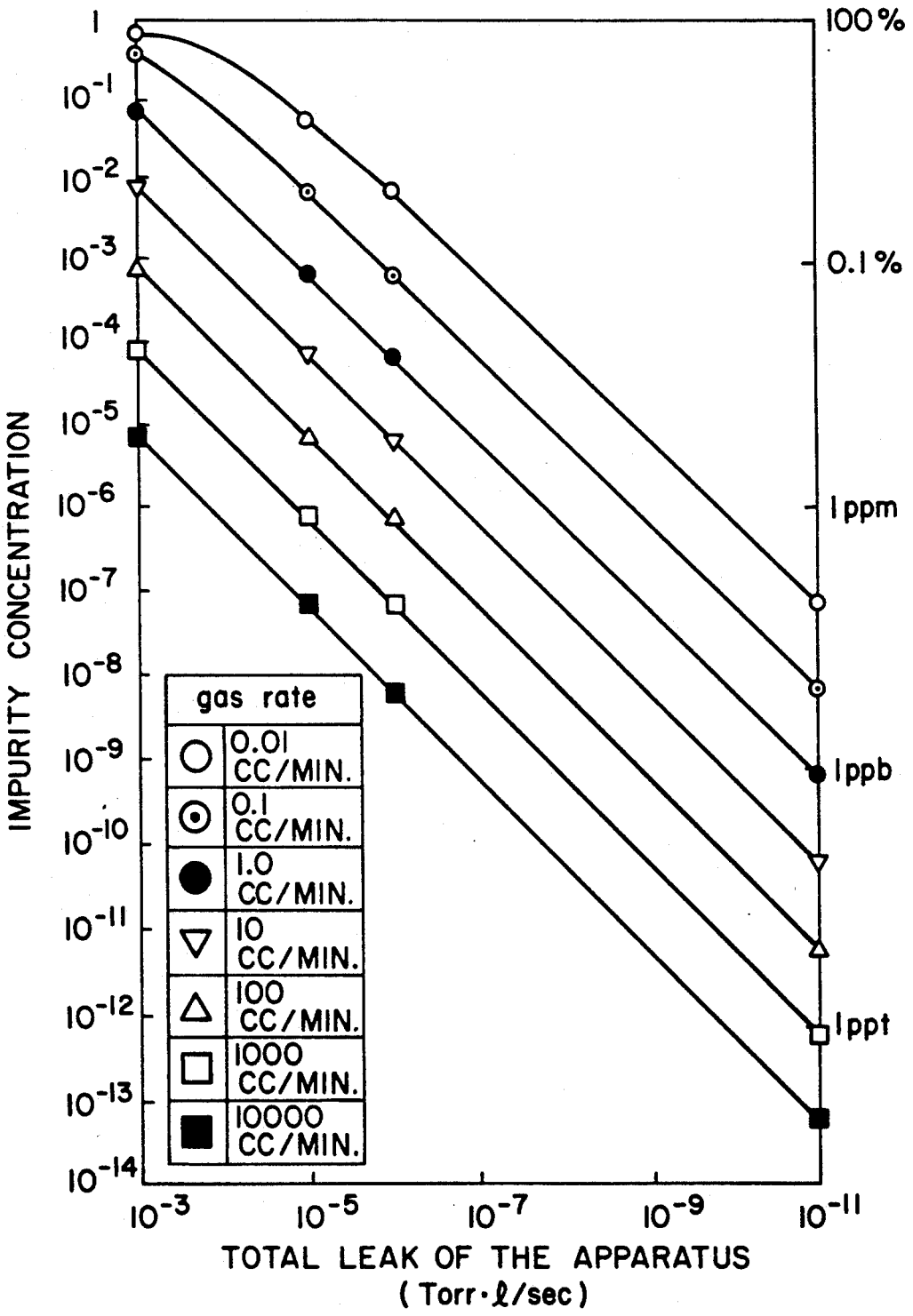
FIG. 9 is a graph showing the relation between total leakage of the system including gas piping system and reaction chamber in each apparatus end gas contamination.

FIG. 8 shows an example of the piping system to prevent the system contamination during gas switch-over. 116 and 118 correspond to mass flow controller and gas supply pipe as shown in FIG. 1. 801 shows a supply line of oxidation atmosphere gas (such as $O_2$) and 802 a supply line of the purge gas (such as Ar). The material differs according to the number of stainless steel pipes to be oxidized or to the size of the oxidation furnace 102. It is usually made of SUS316L pipe of ⅜" or ½" with electropolished inner surface. 803, 804, 805 and 806 represent stop valves. They are a mono-block valve, in which 4 valves are integrated to minimize the dead space. 807 and 808 are the spiral pipes to prevent the intermingling due to reverse diffusion of atmospheric components from the discharge outlet, and 809 and 810 are the float type flowmeters with needle valves. Naturally, the float type flowmeter with separated needle valve or the mass flow controller may be used as 809 or 810. 811 and 812 are the discharge lines, where the gas is discharged after adequate discharge treatment. 813 is an atmosphere gas supply line to supply the gas to oxidation furnace 102 shown in FIG. 1.

Next, description will be given on the operation of the piping system of FIG. 8.

When purging is performed inside the oxidation furnace, the valves 803 and 806 are closed and 804 is opened, and the purge gas is supplied from 802 through 118 and 116. In this case, the valve 805 is opened to purge the oxidation atmosphere gas from 801 through 807 and 809 to the discharge line 811. When the purging in the oxidation furnace is completed, the valves 804 and 805 are closed and 803 is opened, and oxidation atmosphere gas is supplied to the atmosphere gas supply line 813. In this case, the valve 806 is opened, and the purge gas is purged to the discharge line 812.

Also, when oxidation atmosphere gas is supplied into oxidation furnace 102 in FIG. 6, it is desirable not to release the oxidation atmosphere gas out of the holders 103 and 104 by decreasing the supply pressure of the oxidation atmosphere gas (for example $O_2$ supplied from the gas supply piping line 118) flowing inside the pipe to lower than the pressure of inert gas (for example Ar supplied from the gas supply piping line for purge 119) flowing outside the stainless steel pipe 101 by 0.1 to 0.3 kg/cm$^2$, to prevent the oxidation and contamination of outer surface of stainless steel pipe 101. However, if there is no need to protect the outer surface of stainless steel pipe from oxidation or contamination, it is naturally unnecessary to give differential pressure to the gases flowing inside and outside the stainless steel pipe and to provide inert atmosphere outside the stainless steel pipe.

Figure 7:
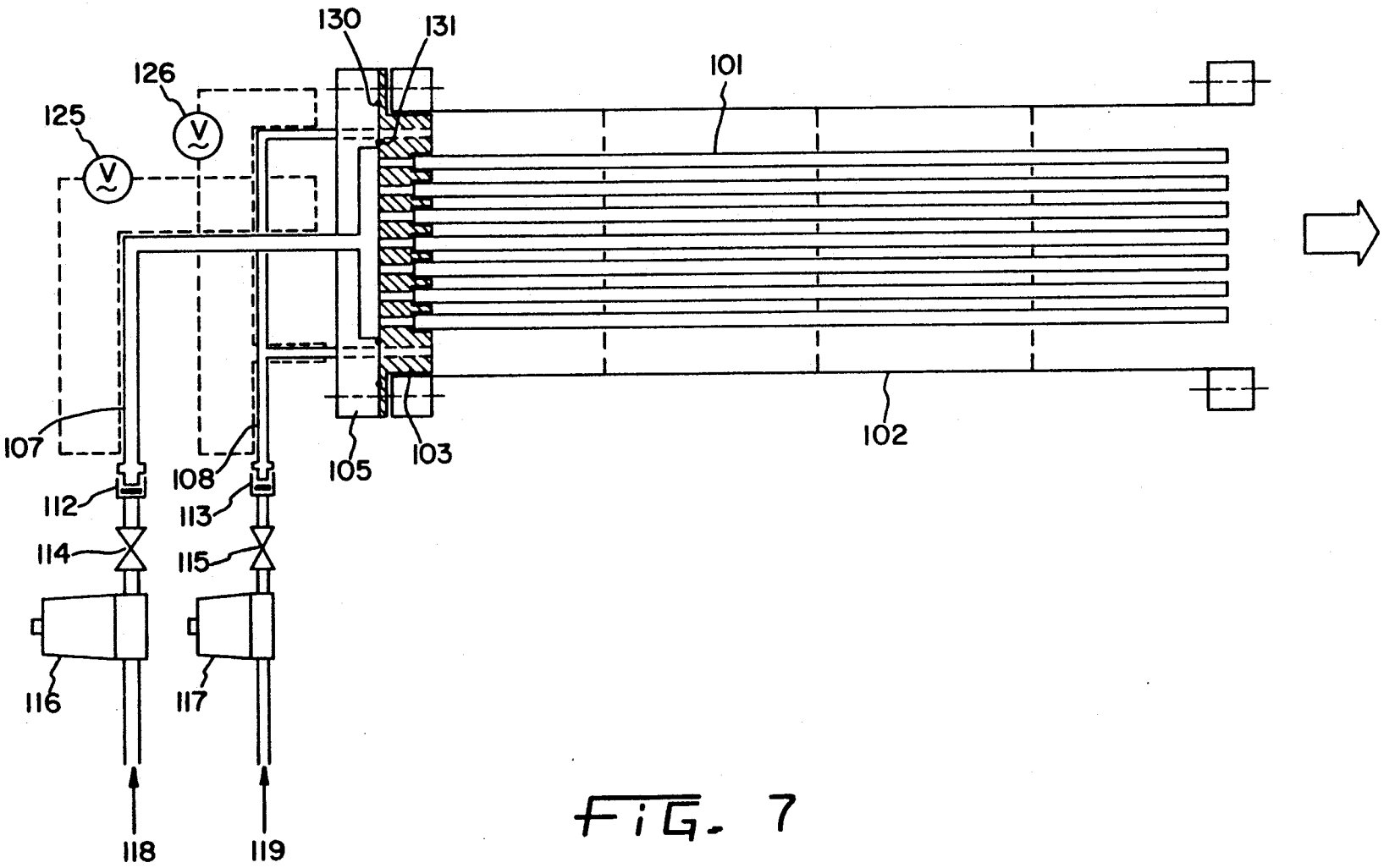
FIG. 7 is a cutaway view of an embodiment of the present invention showing the introduction of oxidation and purge gas.

When moisture content in the gas discharged from the outlet was measured in this embodiment, the stabilized value of less than 10 ppb was obtained during oxidation treatment. Particularly, the time to attain the value of less than 10 ppb could be reduced in the equipment configuration of FIG. 7. In the piping system of FIG. 8, the value of less than 10 ppb could be maintained even during gas switch-over.

Figure 10:
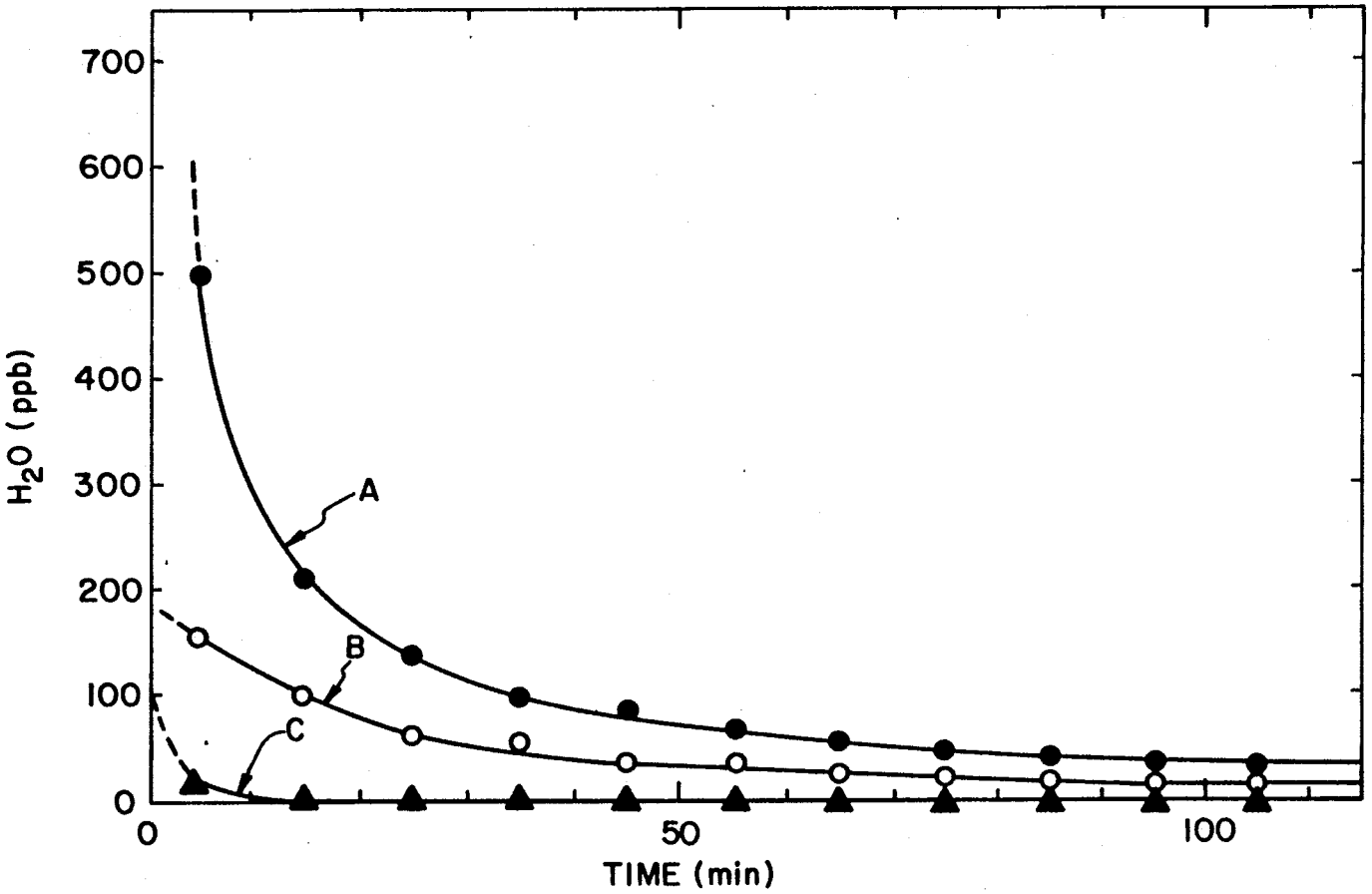
FIG. 10 is a graph showing changes of moisture contained in the purged gas when the stainless steel pipe with difference internal process conditions are purged at normal temperature.

Further, after the stainless steel pipe of ⅜" with total length of 2 m as obtained by the present embodiment was left for about one week in a clean room maintained at relative humidity of 50% and at temperature of 20° C., argon gas was passed through at flow rate of 1.2 l/min., and moisture content in argon gas at the outlet was measured by APIMS (atmospheric pressure ionization mass spectrometer). As shown by C in the graph of FIG. 10, the value dropped to 7 ppb within 5 minutes after gas was passed and to less than the background level of 3 ppb after 15 minutes. This reveals that the stainless steel pipe obtained by the embodiment of this invention has excellent degassing property to the adsorbed gas and that the heating oxidation was performed in ultra-high clean atmosphere containing moisture of less than 10 ppb.

As described above, the embodiment according to the invention can provide ultra-high clean oxidation atmosphere with moisture content of less than 10 ppb, which the conventional metal oxidation apparatus and metal oxidation method could not actualize, and this is done at low cost and with better production efficiency.

In the embodiment above, description was given to the apparatus of FIG. 1 for the passivation treatment of stainless steel pipe, whereas it is obvious that the invention is applicable not only to the passivation treatment of stainless steel pipe but also to the treatment of the metals with different material and shape, e.g. the pipes, valves, etc. of Ni, Al, etc. or to the passivation treatment of the parts of highly clean reduced pressure apparatus. Also, the oxidation furnace 102 in the present embodiment is of horizontal type, while it may be of vertical type.

The following effects can be obtained by this invention:

(1) The invention makes it possible to efficiently eliminate the moisture from oxidation atmosphere, to perform heating oxidation for the oxidized metal such as stainless steel in ultra-high olean and dry oxidation atmosphere containing very few impurities such as moisture, and to form the passivation film with less released gas containing moisture on the surface of the said oxidized metal in easier and efficient manner.

(2) Even on the inner surface of the oxidized metal having the shape to hinder gas flow, such as thin stainless steel pipe, the invention can perform heating oxidation in ultra-high clean and dry oxidation atmosphere with very few impurities such as moisture and can form the satisfactory passivation film with less released gas containing moisture in easier and efficient manner.

(3) In addition to the effects of (1) and (2) above, the invention makes it possible to form the passivation film only on the inner surface of the tubular oxidized metal such as stainless steel pipe and to prevent the oxidation of outer surface. This contribute to the elimination of the problems such as the roughing or contamination of outer surface after oxidation treatment or the generation of particles when piping is installed in a clean room.

(4) In addition to the effect of (3) above, the invention makes it possible to prevent the oxidation of outer surface of the tubular oxidized metal such as stainless steel pipe.

(5) In addition to the effects of (1) to (4) above, the invention contributes to the effective prevention of the contamination by moisture from atmospheric air when the oxidized metal is arranged or fixed within the oxidation furnace, to reduce the time to attain ultra-high clean and dry oxidation atmosphere, and to form the more efficient and satisfactory passivation film.

(6) In addition to the effects of (1) to (5) above, the invention makes it possible to prevent the contamination within the system, mostly by moisture, during gas switch-over from the purge gas to oxidation atmosphere gas or from oxidation atmosphere gas to the purge gas, and to permanently maintain ultra-high clean atmosphere even during gas switch-over. Consequently, it is possible not only to form the passivation film satisfactorily but also to simplify the operation, and there is no need to decrease the temperature in the oxidation furnace during gas switch-over. This contributes to the reduction of the time required for the process, to the saving of energy because no reheating of oxidation furnace is required, and to the extensive cost reduction.

(7) In addition to the effects of (1) to (6) above, the invention contributes to the maintenance of uniform temperature of oxidation treatment by heating the gas to the temperature of oxidation atmosphere, to the stabilized control of the processing conditions and to the improvement of the oxidation efficiency.

As described in (1) to (7) above, the invention makes it possible to actualize mass production of the metal parts such as stainless steel or stainless steel pipe having the passivation film with very few gas release and having excellent anti-corrosive property. With stainless steel pipe thus obtained, it is now possible to provide the system, which can supply ultra-high purity gas to the process equipment within short time, in easier manner and at low cost.

We claim:

1. A metal oxidation treatment for forming a passivation film on a surface of a metal tube to be oxidized, comprising:

an oxidation furnace;

a holder functioning as a connection joint for attaching a said metal tube to said oxidation furnace;

a first inlet for introducing an oxidation gas into said oxidation furnace, said first inlet adapted to contact one end of a said metal tube;

a second inlet for introducing purge gas into said oxidation furnace, said second inlet adapted to prevent a said purge gas from contacting an interior surface of a said metal tube;

a first discharge outlet for discharging a said oxidation gas from said oxidation furnace, said first discharge outlet adapted to contact an other end of a said metal tube;

a second discharge outlet for discharging a said purge gas from said oxidation furnace, said second discharge outlet adapted to prevent a said purge gas from contacting an interior surface of a said metal tube; and a heater for heating said oxidation furnace to a predetermined temperature;

whereby a said metal tube is heated and oxidized in a dry oxidation atmosphere while a said oxidation gas and a said purge gas flow in said oxidation furnace, a said oxidation gas flowing through and oxidizing a said metal tube, a said purge gas protecting an outer surface of a said metal tube from oxidation.

2. A metal oxidation treatment apparatus as set forth in claim 1, further comprising a gas line for switching over the purge gas and the oxidation gas to said first inlet, and means for permanently discharging gas in a line not supplying gas to said oxidation furnace for maintaining the oxidation atmosphere within said oxidation furnace at a highly clean condition.

3. A metal oxidation treatment apparatus as set forth in claim 1, further comprising another heater on an oxidation atmosphere gas line and a purge gas line connected with at least one of said first and second inlets, and the temperature of a said oxidation gas to be supplied to said oxidation furnace is heated up to the temperature of the oxidation atmosphere.

4. A metal oxidation treatment apparatus as set forth in claim 1, wherein said oxidation furnace is opened from at least one of said first and second discharge outlets, and a gas line for a said purge gas is connected to introduce the purge gas to said at least one of said first and second inlets when said oxidation furnace is opened, said metal tube prevented from being exposed to atmospheric air when fixed in said oxidation furnace.

5. A metal oxidation treatment apparatus as set forth in claim 4, further comprising a gas line for switching over the purge gas and the oxidation gas to said first inlet, and means for permanently discharging gas in the line not supplying gas to said oxidation furnace for maintaining the oxidation atmosphere at a highly clean condition.

6. A metal oxidation treatment apparatus as set forth in claim 4, wherein another heater is provided on an oxidation atmosphere gas line and a purge gas line connected with at least one of said first and second inlets, and the temperature of a said oxidation gas to be supplied to said oxidation furnace is heated up to the temperature of the oxidation atmosphere.

* * * * *